US009010295B2

(12) United States Patent
Yamagishi et al.

(10) Patent No.: US 9,010,295 B2
(45) Date of Patent: Apr. 21, 2015

(54) INTAKE SYSTEM FOR INTERNAL COMBUSTION ENGINE

(75) Inventors: Naoto Yamagishi, Saitama (JP); Masakazu Tanaka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 495 days.

(21) Appl. No.: 13/337,929

(22) Filed: Dec. 27, 2011

(65) Prior Publication Data

US 2012/0180746 A1 Jul. 19, 2012

(30) Foreign Application Priority Data

Jan. 14, 2011 (JP) ..... 2011-005934

(51) Int. Cl.

| | |
|---|---|
| ***F02M 35/10*** | (2006.01) |
| ***F01M 13/00*** | (2006.01) |
| ***F02B 25/00*** | (2006.01) |
| ***F02M 27/00*** | (2006.01) |
| ***F02M 29/00*** | (2006.01) |
| ***F02M 35/16*** | (2006.01) |
| ***F02M 35/024*** | (2006.01) |

(52) U.S. Cl.

CPC ..... *F02M 35/162* (2013.01); *F02M 35/024* (2013.01); *F02M 35/10098* (2013.01); *F02M 35/10177* (2013.01); *F02M 35/10216* (2013.01); *F02M 35/10255* (2013.01)

(58) Field of Classification Search

CPC ..... F02B 27/02; F02M 35/10118; F02M 35/10301; F02M 35/112; F02M 35/10144; F02M 35/10321; F01M 13/04; F01M 13/00; F01M 13/021; F01M 13/022; F01M 25/06; F01M 3/04; F01M 11/045; F01M 11/0458; F01M 11/08

USPC ..... 123/184.56, 184.21, 184.24, 41.86, 572

See application file for complete search history.

(56) References Cited

U.S. PATENT DOCUMENTS

| | | | | |
|---|---|---|---|---|
| 4,495,802 | A | 1/1985 | Kashiwaya et al. | |
| 6,202,626 | B1 * | 3/2001 | Ito et al. | 123/336 |
| 7,246,611 | B2 * | 7/2007 | Mashiko | 123/572 |
| 2005/0205325 | A1 * | 9/2005 | Nojima | 180/219 |
| 2007/0289583 | A1 * | 12/2007 | Konakawa et al. | 123/590 |
| 2010/0139617 | A1 | 6/2010 | Akiyama et al. | |

FOREIGN PATENT DOCUMENTS

JP 2010-059894 A 3/2010

* cited by examiner

*Primary Examiner* — Lindsay Low
*Assistant Examiner* — Syed O Hasan
(74) *Attorney, Agent, or Firm* — Birch, Stewart, Kolasch & Birch, LLP

(57) ABSTRACT

An intake system for an internal combustion engine, having a structure in which blow-by oil and/or fuel entering into an air cleaner case can be discharged to the outside of the air cleaner case. The intake system for an internal combustion engine is provided in which air is sucked from a clean air chamber in the air cleaner case into a throttle body provided with a throttle valve through a funnel while defining an airflow passage. Concurrently, fuel is sprayed from an injector, thereby feeding the fuel-air mixture into an intake port. A bypass passage different from the airflow passage is provided between the clean air chamber in the air cleaner case and the throttle body. The bypass passage is so structured that a passage inlet thereof on the clean air chamber side opens at an inner wall surface of the air cleaner case.

18 Claims, 8 Drawing Sheets

INTAKE SYSTEM FOR INTERNAL COMBUSTION ENGINE

CROSS-REFERENCE TO RELATED APPLICATIONS

The present application claims priority under 35 USC 119 to Japanese Patent Application No. 2011-005934 filed on Jan. 14, 2011 the entire contents of which are hereby incorporated by reference.

BACKGROUND OF THE INVENTION

1. Field of the Invention

The present invention relates to an intake system for an internal combustion engine which is to be applied to a motorcycle or other vehicles.

2. Description of Background Art

An intake system for an internal combustion engine which is to be applied to a motorcycle or the like is known wherein a structure is provided in which a contrivance is made to cope with leakage of blow-by oil and/or fuel through a fastened portion between an air cleaner case and a throttle body. See, for example, Japanese Patent Laid-Open No. 2010-59894.

Japanese Patent Laid-Open No. 2010-59894 discloses a structure of a motorcycle which includes a throttle body having an air passage to permit a flow of air to an engine; a cleaner box (air cleaner case) joined to the throttle body and conducting clean air into the throttle body; screws for fastening the cleaner box and the throttle body to each other on the outside of a left-side air passage and a right-side air passage of the air passage; and a seal portion for sealing the joined portion between the cleaner box and the throttle body, wherein the seal portion is disposed so as to surround the outside of the screw fastening positions, the left-side air passage and the right-side air passage.

By this structure, exudation of blow-by oil and/or fuel through the fastened portion between the cleaner box and the throttle body is restrained.

In the structure as disclosed in Japanese Patent Laid-Open No. 2010-59894, there is provided a function to prevent blow-by oil and/or fuel from exuding via the joined portion between the throttle body and the cleaner box. In addition, it is possible to prevent the outer surfaces of the engine from being contaminated by engine oil and/or fuel.

However, since the sealing between the throttle body and a funnel is made at a funnel extension portion (the lower end portion of the funnel which is to be inserted into the throttle body), the dimensions of the funnel extension portion are specified rigorously, leading to troublesome tolerance control at the time of manufacture.

SUMMARY AND OBJECTS OF THE INVENTION

The present invention has been made in consideration of the above-mentioned circumstances. Accordingly, it is an object of an embodiment of the present invention to provide an intake system for an internal combustion engine which has such a structure in which exudation of blow-by oil or the like can be prevented without need for rigorous tolerance control with respect to a throttle body and a funnel extension portion at the time of manufacture.

In order to attain the above object, according to an embodiment of the present invention, an intake system for an internal combustion engine, in which an airflow passage for sucking air from a clean air chamber in an air cleaner case into a throttle body equipped with a throttle valve through a funnel is formed and a fuel-air mixture is fed into an intake port, is characterized in that:

the funnel includes a barrel portion defining the airflow passage, a stepped portion which is provided on the downstream side of the barrel portion so as to form a sealing surface between the funnel and the air cleaner case, and a fitting portion which is provided on the downstream side of the stepped portion and inserted to the inside of the throttle body;

a bypass passage different from the airflow passage is provided at an outer periphery of the fitting portion between the clean air chamber in the air cleaner case and the throttle body; and the bypass passage is so structured that a passage inlet thereof on the clean air chamber side opens at an inner wall surface of the air cleaner case.

According to an embodiment of the present invention, the intake system is characterized in that the bypass passage is a recessed groove provided in the fitting portion.

According to an embodiment of the present invention, the bypass passage is a cutout provided in the fitting portion.

According to an embodiment of the present invention, the bypass passage has a passage outlet thereof formed at a downstream end surface of the funnel.

According to an embodiment of the present invention, the bypass passage is configured so as to extend along an axis of the throttle body and to gradually increase in bore sectional area from the passage inlet toward the passage outlet.

According to an embodiment of the present invention, a plurality of the bypass passages can be provided.

According to an embodiment of the present invention, the barrel portion has a space provided between an inner peripheral surface defining the airflow passage and an outer peripheral surface.

According to an embodiment of the present invention, the intake system is provided with a bypass passage different from an ordinary airflow passage intermediated by a funnel, and a passage inlet of the bypass passage on the clean air chamber side opens at an inner wall surface of the clean air chamber. This configuration permits oil and fuel deposited on the inner wall surface or the like of the clean air chamber in the air cleaner case to flow from the passage inlet opening at the inner wall surface of the clean air chamber to the throttle body side through the bypass passage. Further, the bypass passage enables forcible suction of the deposited oil and the like, while generating a suction force via the passage port of the bypass passage, by utilizing the intake airflow through the airflow passage defined inside the funnel. Therefore, extremely effective suction can be accomplished. Accordingly, the oil and the fuel which might cause contamination of the inside of the air cleaner box and contamination of the air filter can be effectively discharged together with the intake airflow. This can also make a good influence on the service life of the air filter, for example.

According to an embodiment of the present invention, the bypass passage is composed of a recessed groove provided in the fitting portion. This configuration permits not only easy formation of the bypass passage but also adoption of a structure in which it is unnecessary to process the throttle valve or the air cleaner case. Accordingly, it is possible to suppress a rise in processing cost, and the inner peripheral surface of the funnel through which intake air flows can be made smooth, further enabling a smooth flow of the intake air.

According to an embodiment of the present invention, the bypass passage is composed of a cutout provided in the fitting portion. This not only facilitates the formation of the bypass passage but also permits the fitting portion to deform so as to contract in the radial direction. Consequently, the fitting portion can be inserted into the throttle body even in the presence of some dimensional tolerance errors, and assembling is thereby enhanced.

According to an embodiment of the present invention, the passage outlet of the bypass passage is formed at the downstream end surface of the funnel passage. Therefore, the bypass passage structure can be prevented from having a bad influence on the airflow in the airflow passage inside the funnel. Accordingly, smooth flow of intake air in the vicinity of the funnel can be secured simultaneously with the discharge of the oil and the like present in the air cleaner case.

According to an embodiment of the present invention, the bore sectional area of the bypass passage gradually increases downstream with respect to the intake airflow. This configuration ensures that, in regard of the airflow sucked in through the passage inlet of the bypass passage, the flow velocity of suction by the airflow in the airflow passage inside the funnel can be effectively increased. Therefore, stronger suction via the passage inlet is achieved. Accordingly, the oil and fuel which might cause contamination of the inside of the air cleaner box and contamination of the air filter can be discharged more effectively.

According to an embodiment of the present invention, a plurality of the bypass passages are provided so that a plurality of passage inlets serving as suction apertures are formed. This permits the oil and fuel deposited in the clean air chamber of the air cleaner case can effectively flow to the throttle body side by way of a plurality of locations. Consequently, the oil and fuel which might cause contamination of the inside of the air cleaner box and contamination of the air filter can be discharged more effectively.

According to an embodiment of the present invention, the barrel portion of the funnel is provided with a space between the inner peripheral surface defining the intake airflow passage and the outer peripheral surface. This configuration permits a reduction in weight of the funnel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
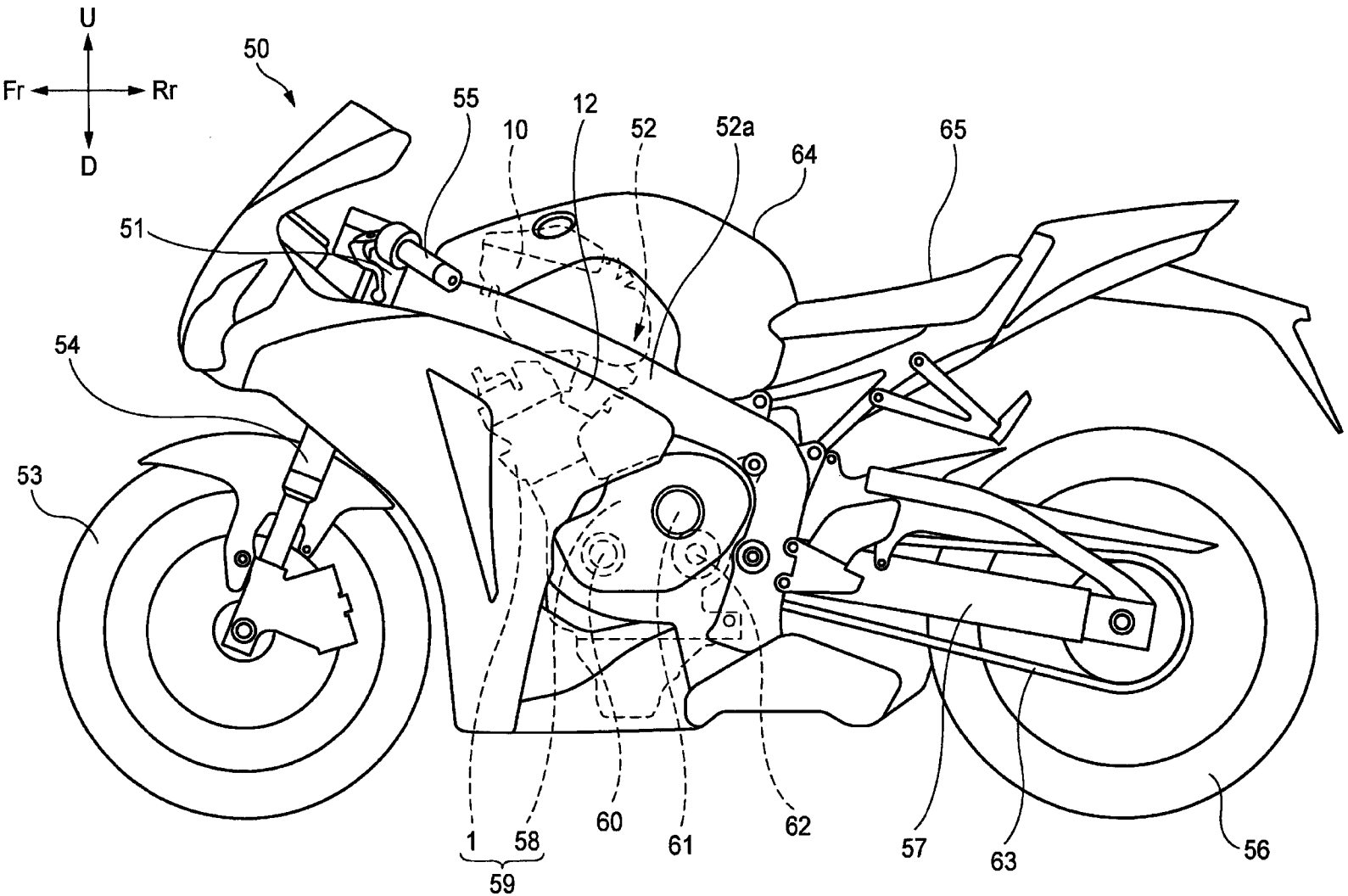
FIG. 1 is a left side view of a motorcycle to which an intake system for an internal combustion engine according to the present invention is applied.

Now, a first embodiment of the present invention will be described in detail below, referring to FIGS. 1 to 4.

This first embodiment is an intake system for an internal combustion engine which is applied to a motorcycle. The drawings are to be viewed in the direction of reference symbols. In the drawings, Fr represents forward, Rr rearward, U upward, and D represents downward.

FIG. 1 is a side view of a motorcycle 50 equipped with an intake system 10 for an internal combustion engine 1 according to the present invention.

The motorcycle 50 has a head pipe 51 at a front end portion of the vehicle, and a body frame 52 has a pair of main frames 52*a* branched from the head pipe 51 to the left and the right and extending rearwardly while being inclined rearwardly downwardly. In addition, a front fork 54 supporting a front wheel 53 is steerably supported on the head pipe 51, and a steering handle bar 55 is connected to an upper portion of the front fork 54.

A rear fork 57 supporting a rear wheel 56 is supported on the body frame 52 so as to be swingable upward and downward, and the rear fork 57 is suspended from a main frame 52*a* through suspension means. On the body frame 52, a power unit 59 is mounted which includes an internal combustion engine 1 having cylinders, for example four cylinders, arrayed in a direction orthogonal to the traveling direction of the vehicle, and a transmission 58.

The power unit 59 includes a crankshaft 60 and a transmission main shaft 61 and a transmission counter shaft 62. An output shaft of the power unit 59 is the counter shaft 62, from which power is transmitted to the rear wheel 56 through a drive sprocket (not shown) at the left end of the counter shaft 62 and a chain transmission mechanism 63.

In addition, a fuel tank 64 is provided at an upper portion of the body frame 52, and a tandem seat 63 is provided at a rear portion.

Figure 2:
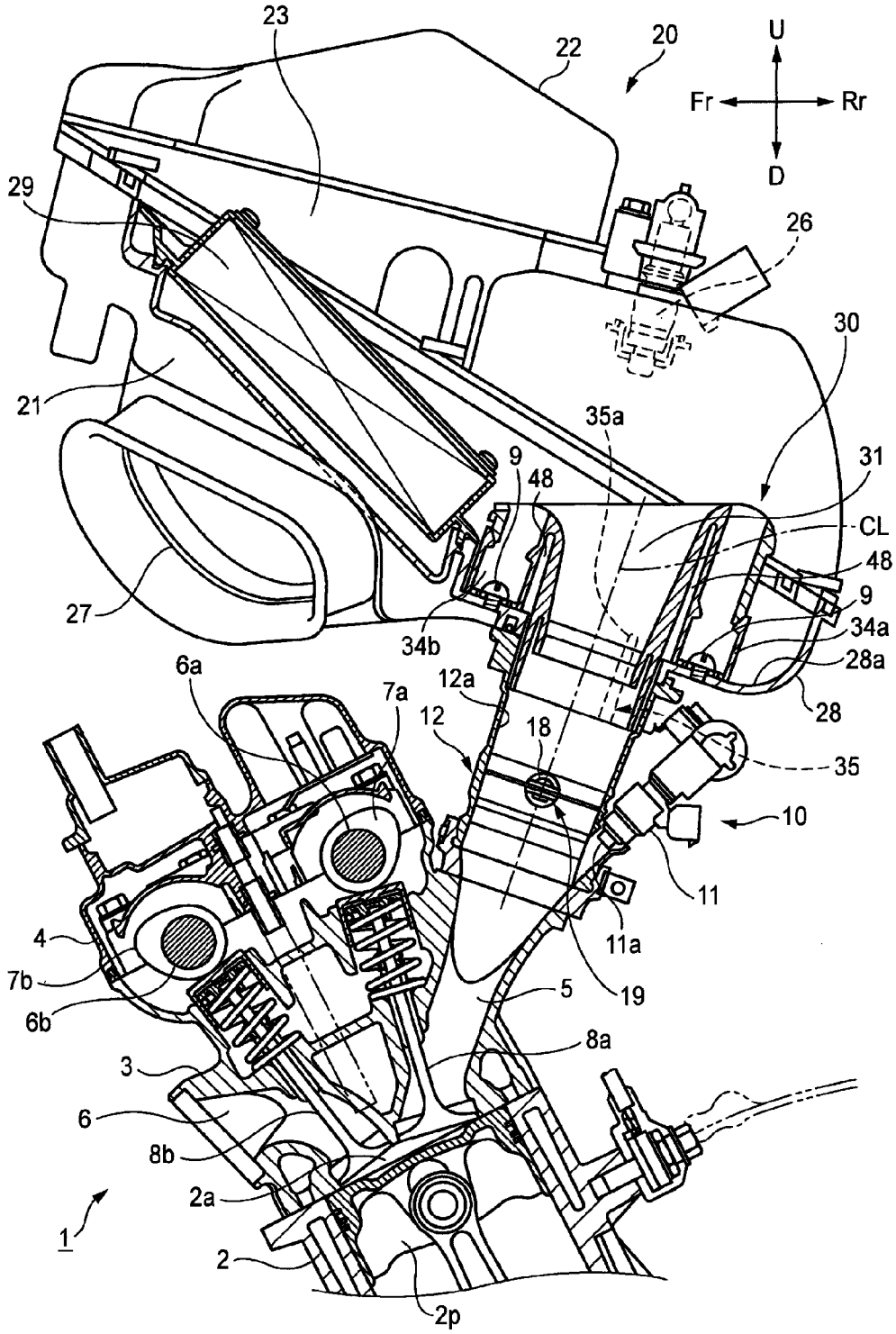
FIG. 2 is a sectional view of a major part of a first embodiment of the intake system for an internal combustion engine according to the present invention.

FIG. 2 is a vertical sectional view, as viewed from the left, of the vicinity of a throttle body 12 and an air cleaner case 20 which constitute the intake system 10 for the internal combustion engine 1 according to the present embodiment.

First the internal combustion engine 1 in this embodiment will be described in brief.

The internal combustion engine 1 includes a cylinder head 3 on the upper side of a cylinder 2 with a piston 2*p*. The cylinder head 3 is provided with an intake valve 8*a* for controlling intake via an intake port 5 and an exhaust valve 8*b* for controlling exhaust via an exhaust port 6.

In addition, the intake valve 8*a* and the exhaust valve 8*b* are appropriately operated by the rotation of cams 7*a*, 7*b* provided on a pair of camshafts 6*a*, 6*b* arranged on the upper end side of the valves. Further, the camshafts 6*a*, 6*b* and the cams 7*a*, 7*b* are appropriately covered with a head cover 4 on the upper side.

In the intake system 10 in the present embodiment, the throttle body 12 is disposed adjacent to the intake port 5. The throttle body 12 is provided with a downstream-side injector 11 and a throttle valve 19 which has a rotating shaft 18 for oscillation thereon. In addition, the air cleaner case 20 described later is appropriately connected to the throttle body 12.

The downstream-side injector 11, disposed on the most downstream side with respect to an intake flow inside the throttle body 12, sprays fuel toward the intake port 5. More specifically, the downstream-side injector 11 is configured so that a spray port 11*a* is located downstream of the throttle valve 19. The fuel is sprayed toward the downstream side of the intake port 5 at an appropriate angle of inclination against a center line CL of the throttle body 12.

In the inside of the air cleaner case 20 connected to an upper portion of the throttle body 12, a filter element 29 is installed in a front half zone. An air inflow port 27 is opened at a front portion of the air cleaner case 20. An inflow air chamber 21 is foamed between the air inflow port 27 and the filter element 29.

An upper portion of the air cleaner case 20 is covered with a cover 22, and a clean air chamber 23 is defined on the upper side of the filter element 29. At the rear of the filter element 29, a tubular funnel 30 is provided for guiding clean air from the clean air chamber 23 into the throttle body 12. In addition, at the cover 22 an upstream-side injector 26 is provided which can spray the fuel.

Further, while only one throttle body 12 and only one funnel 30 are shown in FIG. 2, in practice throttle bodies and funnels according to the number of the cylinders are provided in a juxtaposed fashion. More specifically, a case lower wall 28 constituting the clean air chamber 23 in the air cleaner case 20 is provided with a plurality of through-holes, into which tubular funnels 30 are inserted and appropriately fixed by screws 9 or the like.

The intake system 10 configured as above-described functions so that air is sucked from the clean air chamber 23 in the air cleaner case 20 into the throttle body 12 equipped with the throttle valve 19 through an airflow passage 31 defined inside the funnel 30 while forming a comparatively smooth airflow. Concurrently, the fuel is sprayed from the injectors 11 and 26, to feed fuel-air mixture into the intake port 5.

Then, in a combustion chamber 2*a* of the internal combustion engine 1 the fuel-air mixture supplied by the intake system 10 is combusted, whereby a rotational output generated by the piston 2*p* can be outputted.

In the present embodiment, a structure in which a bypass passage 35 separate from the airflow passage 31 is provided between the clean air chamber 23 in the air cleaner case 20 and the throttle body 12 is the characteristic structure.

In addition, a structure in which the bypass passage 35 is provided so that its passage inlet 35*a* on the clean air chamber 23 side opens at an inner wall surface 28*a* of the air cleaner case 20 is also characteristic of this embodiment.

More specifically, a structure is provided in which the oil and fuel deposited in the clean air chamber 23 of the air cleaner case 20 can be discharged to the throttle body 12 side through the bypass passage 35. In addition, a structure is provided in which the passage inlet 35*a* is opened directly at the inner wall surface 28*a*, which permits easy discharge of the oil and fuel deposited.

Figure 3:
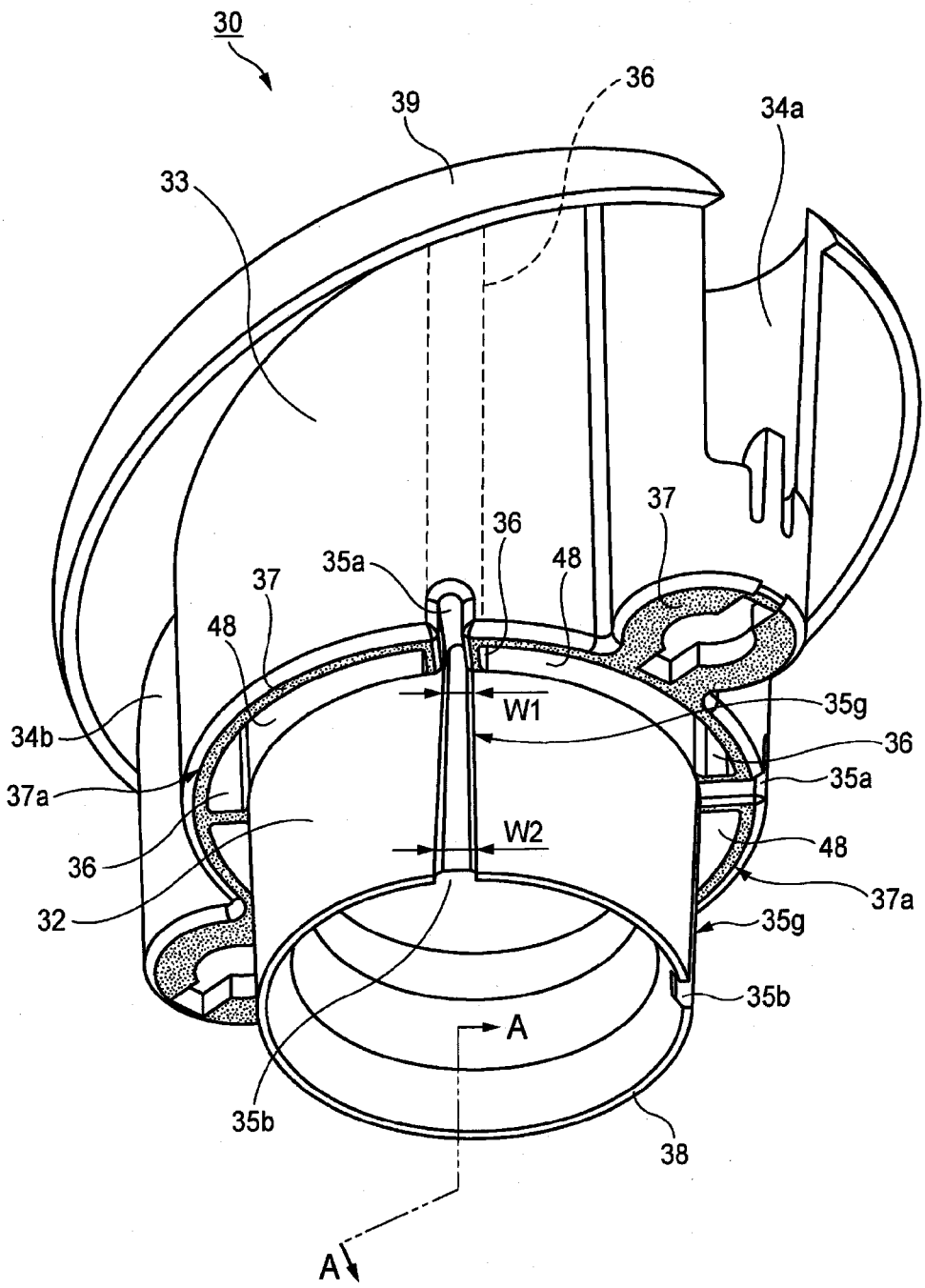
FIG. 3 is an enlarged perspective view, as viewed from below, of a funnel in the intake system according to the first embodiment shown in FIG. 2.
Figure 4:
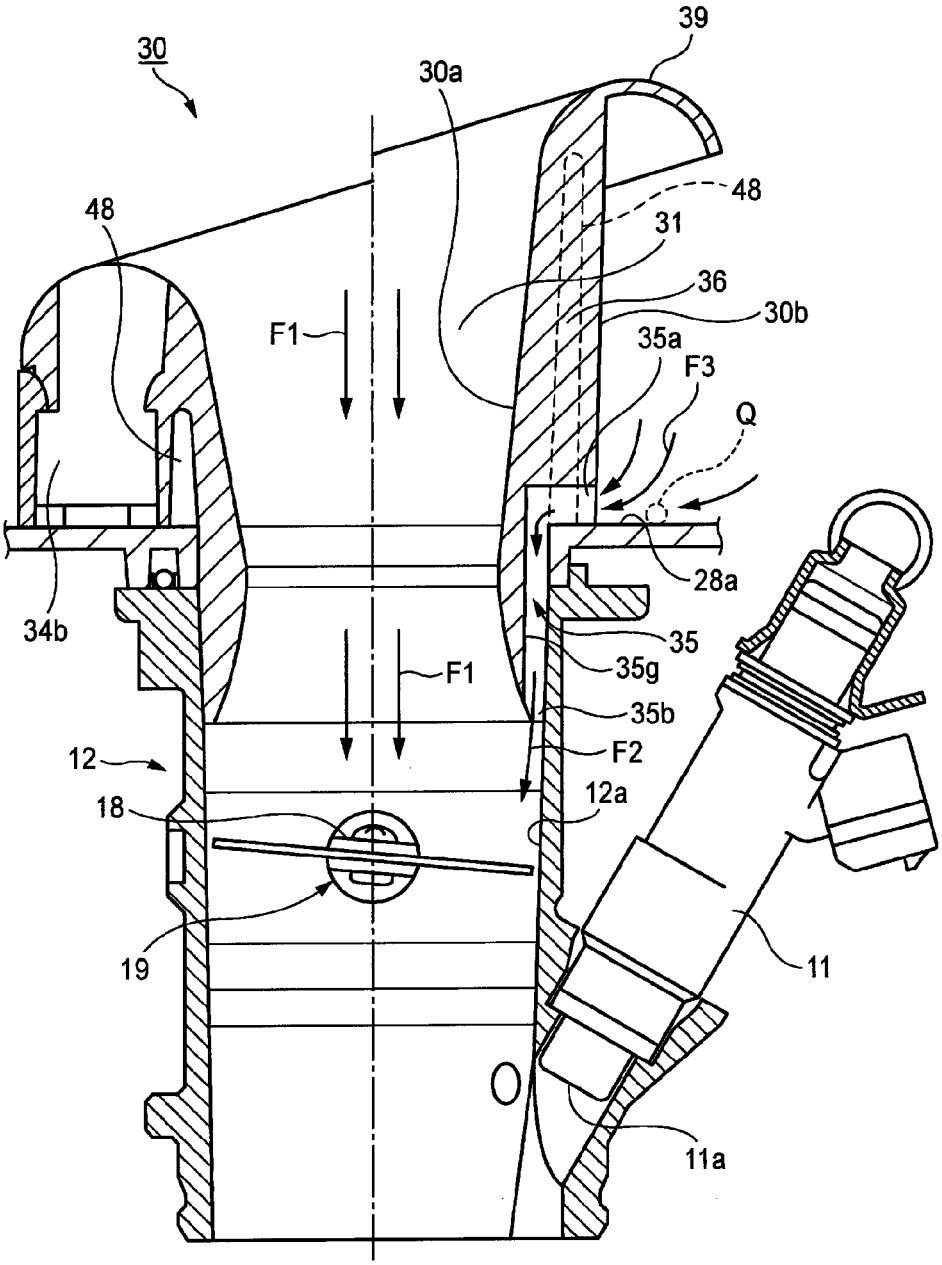
FIG. 4 is an enlarged sectional view of a major part section of the funnel in a mounted state (the section of a funnel portion is A-A section in FIG. 3) in the first embodiment shown in FIG. 3.

The bypass passage 35 is composed, for example, of a recessed groove 35*g* formed in an outer peripheral surface of a fitting portion 32 of the funnel 30, as shown in FIGS. 3 and 4 (the section of the funnel portion in FIG. 4 is a view taken along A-A section in FIG. 3). More specifically, the bypass passage 35 is composed of a space surrounded by the recessed groove 35*g* in the outer peripheral surface of the fitting portion 32 of the funnel 30, which fits to the air cleaner case 20 and the throttle body 12, the inner wall surface 28*a* of the air cleaner case 20, and the inner wall surface 12*a* of the throttle body 12.

In addition, the funnel 30 is fixed by screws 9, 9 (see FIG. 2) in screw mounting portions 34*a*, 34*b* in such a manner that a tubular barrel portion 33 projects into the clean air chamber 23. In this embodiment, the fitting portion 32 formed with the recessed grooves 35*g* is provided with a stepped portion 37*a* between itself and the barrel portion 33. At the stepped portion 37*a* a seal surface 37 is provided in such a manner so as to surround the barrel portion 33 along the circumferential direction, for enhancing sealing properties.

In addition, an upper end portion 39 of the barrel portion 33 of the funnel 30 forms a curved surface in the manner of opening outward. Further, the upper end portion 39 is in an oblique shape such that the funnel aperture is appropriately inclined (inclined to be lower on the left side in the drawing) to be oriented to the filter element 29 side.

In the present embodiment, the bypass passage 35 has an extremely simple structure attained by only providing the recessed groove 35*g* in the outer peripheral surface of the funnel 30 which is comparatively easy to mold or form. According to such a structure, the bypass passage 35 can be formed by a method in which the funnel 30 formed with the recessed groove 35*g* is mounted in a predetermined through-hole on the case lower wall 28 of the air cleaner case 20. This structure ensures not only that the bypass passage 35 can be formed very easily but also that the bypass passage 35 can be formed without need for any special processing of the throttle body 12 or the air cleaner case 20.

The recessed groove 35*g* is provided correspondingly to each of two rib portions 36, for example, of four rib portions 36 which are provided along the center line CL of a cylindrical portion of the funnel 30. With the recessed grooves 35*g* thus provided at positions corresponding to the rib portions 36, the recessed grooves 35*g* can be formed by utilizing the material thickness of the relevant portions and while obviating a reduction in the strength of the funnel 30.

In addition, the barrel portion 33 of the funnel 30 has a structure in which a space 48 is provided between the inner peripheral surface 30*a*, which defines the airflow passage 31, and the outer peripheral surface 30*b*. More specifically, the spaces 48 are each formed between the rib portions 36, and this structure permits the barrel portion 33 to have a three-dimensional structure in the radial direction, thereby ensuring an enhanced rigidity, and promises a reduction in weight.

When the bypass passages 35 are formed at two locations and a plurality of the passage inlets 35*a* are thereby formed, like in the present embodiment, the oil and fuel deposited in the clean air chamber 23 of the air cleaner case 20 can be discharged more effectively via the plurality of positions.

The bypass passage 35 in the present embodiment is configured so as to extend along the axis of the throttle body 12 and to gradually increase in bore sectional area from the passage inlet 35*a* toward the passage outlet 35*b* (with the groove depth being substantially uniform and the groove width increasing so that W1<W2).

The configuration in which the bore sectional area gradually increases downstream with respect to the intake flow ensures that when a suction airflow F3 (see FIG. 4) sucked in through the passage inlet 35*a* of the bypass passage 35 is generated, a sucking-in force arising from an airflow F1 through the airflow passage inside the funnel 30 can be effectively enlarged.

The following is a description of the operation of the bypass passage 35 in the intake system 10 for the internal combustion engine 1 according to the present embodiment.

First, when the internal combustion engine 1 is working, the piston 2*p* shown in FIG. 2 is moved up and down, and the intake valve 8*a* and the exhaust valve 8*b* are opened and closed as required, whereby intake is accomplished through the intake port 5 and exhaust through the exhaust port 6.

The intake air is guided to the intake port 5 in the manner as follows. Air taken in, for example, from the front of the motorcycle 50 flows through the air inflow port 27 into the inflow air chamber 21, and then the air is cleaned by filtration through the filter element 29. After that the clean air enters the clean air chamber 23, and the clean air therefrom flows through the funnel 30 and then through the throttle body 12 for intake amount control, to be led to the intake port 5. In addition, the fuel is sprayed by the upstream-side injector 26 and the downstream-side injector 11, as required, whereby a fuel-air mixture is produced.

It is desirable for the clean air chamber 23 to be always in a clean state. According to the state of combustion in the internal combustion engine 1, however, a condition in which blow-by oil and/or the fuel is likely deposited on the inner walls of the clean air chamber 23 may be generated. As the deposition amount increases, the blow-by oil and/or the fuel may be accumulated as surplus liquid inside the clean air chamber 23. When the surplus liquid Q thus deposited reaches such a size as to be influenced by gravity, it may fall onto the bottom surface of the inner wall surface 28*a*.

In this embodiment, as shown in FIG. 4, the case inner wall surface 28*a* is provided at its bottom surface with the passage inlet 35*a* of the bypass passage 35, and, accordingly, the surplus liquid Q of the oil and/or the fuel inside the clean air chamber 23 can flow through the passage inlet 35*a* and the bypass passage 35 to the throttle body 12 side.

In addition, when the internal combustion engine 1 is working, the airflow F1 through the airflow passage 31 formed inside the funnel 30 produces an airflow F2 by which air at the passage outlet 35*b* of the bypass passage 35 is sucked in.

Due to the airflow F2 at the passage outlet 35*b*, the suction airflow F3 for sucking in air through the passage inlet 35*a* of the bypass passage 35 is generated at the passage inlet 35*a*.

Accordingly, the surplus liquid Q deposited on the inner wall surface 28*a* can be forcibly sucked in through the passage inlet 35*a*.

In addition, the passage outlet 35*b* of the bypass passage 35 opens at a downstream end surface 38 of the passage of the funnel 30. This configuration ensures that the airflow F2 at the passage outlet 35*b* would not generate a transverse flow relative to the airflow F1 in the airflow passage 31, so that stability of the airflow F1 in the airflow passage 31 can be secured.

Furthermore, in the present embodiment, in regard to the suction airflow F3 sucked in through the passage inlet 35*a* of the bypass passage 35, the flow velocity of suction by the airflow F1 in the airflow passage inside the funnel 30 can be effectively increased, since the bore sectional area of the passage outlet 35*b* is greater than that of the passage inlet 35*a*. Consequently, strong suction is achieved on the passage inlet 35*a* side.

Figure 5:
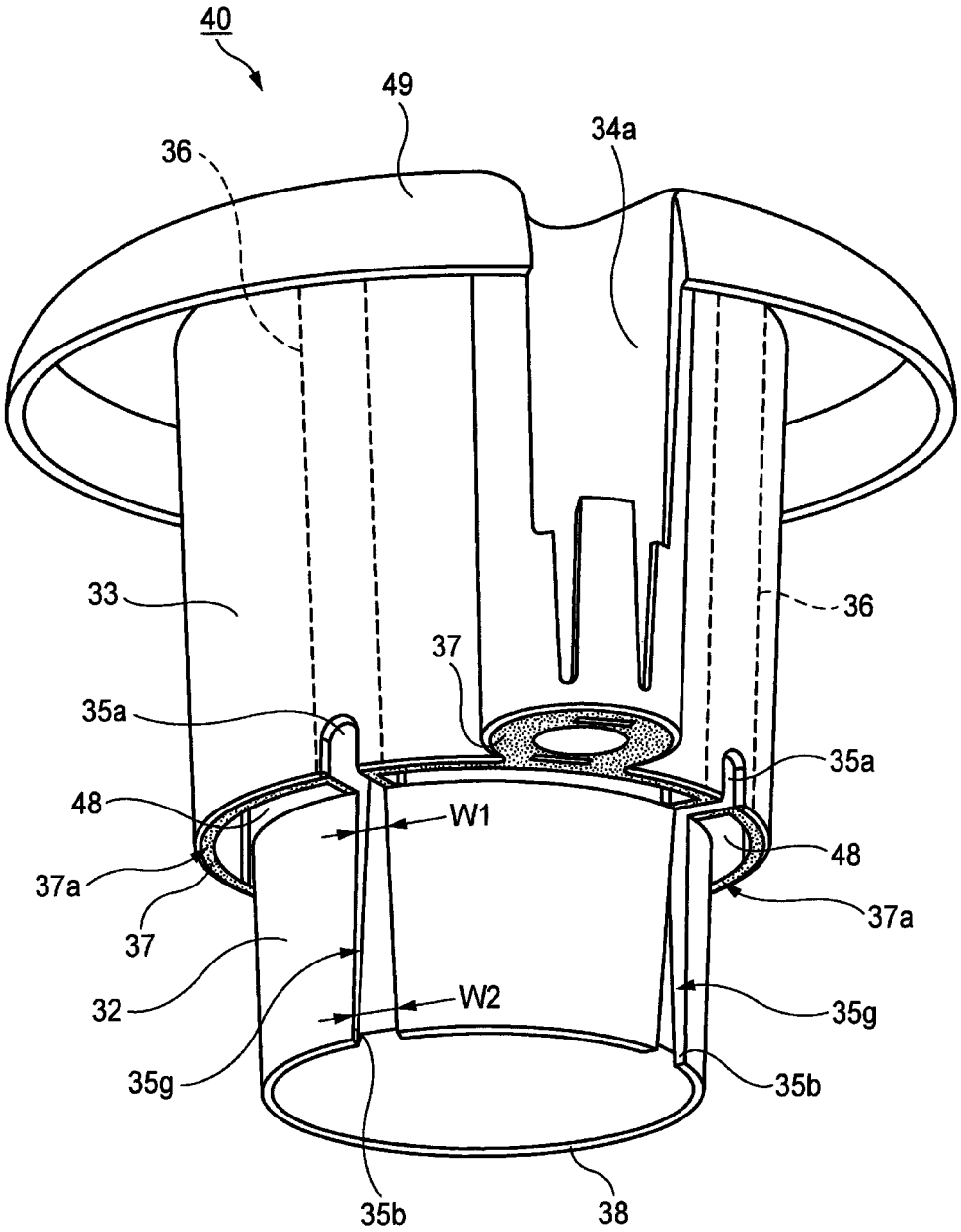
FIG. 5 is an enlarged perspective view, as viewed from below, of a funnel in an intake system according to a second embodiment of the present invention.
Figure 6:
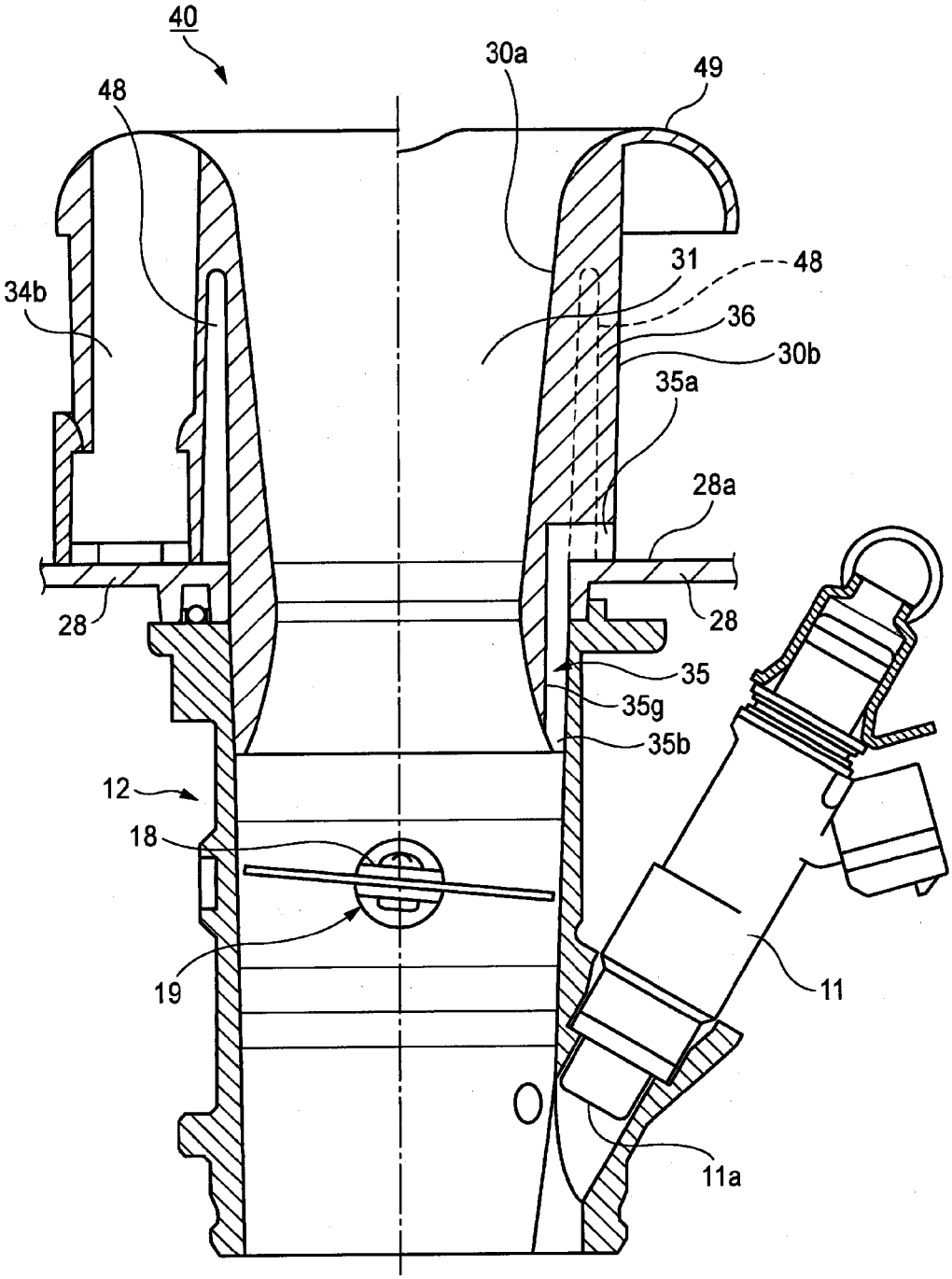
FIG. 6 is an enlarged sectional view showing a major part section of the funnel, in a mounted state, in the second embodiment shown in FIG. 5.

The following will be a description of a second embodiment of the present invention with reference to FIGS. 5 and 6.

The second embodiment is the same as the first embodiment above, except for the configuration of a funnel 40 shown in FIGS. 5 and 6. The same components as those in the first embodiment will be denoted by the same reference symbols as used above, and descriptions of them will be omitted as appropriate.

In this embodiment, like in the first embodiment, a funnel 40 is provided to project into the clean air chamber 23 of the air cleaner case 20. The funnel 40 in this embodiment differs from the funnel 30 in the first embodiment, in the shape of the upper end portion 49 thereof. More specifically, as shown in FIGS. 5 and 6, the height of the upper end portion 49 of the funnel 40 (the height of the barrel portion 33) is uniform. In the other points including the configuration of the recessed grooves 35*g* formed in the fitting portion 32, the second embodiment is the same as the first embodiment.

Therefore, in the funnel 40 according to the present embodiment, also, the bypass passage 35 is composed of a space which is surrounded by the recessed grooves 35*g* in the fitting portion 32 of the funnel 40 for fitting to the air cleaner case 20 and the throttle body 12, the inner wall surface 28*a* of the air cleaner case 20, and the inner wall surface 12*a* of the throttle body 12, like in the first embodiment.

Since the upper end portion 49 of the funnel 40 is uniform in height, the funnel 40 can be applied to air cleaner cases different in shape from the air cleaner case in the first embodiment.

Thus, the shape of the funnel 40 is changed, if necessary, according to the structure and shape of the air cleaner case in the intake system and the mounting position of the funnel 40 in the air cleaner case.

A third embodiment of the present invention will be described below referring to FIGS. 7 and 8.

Figure 7:
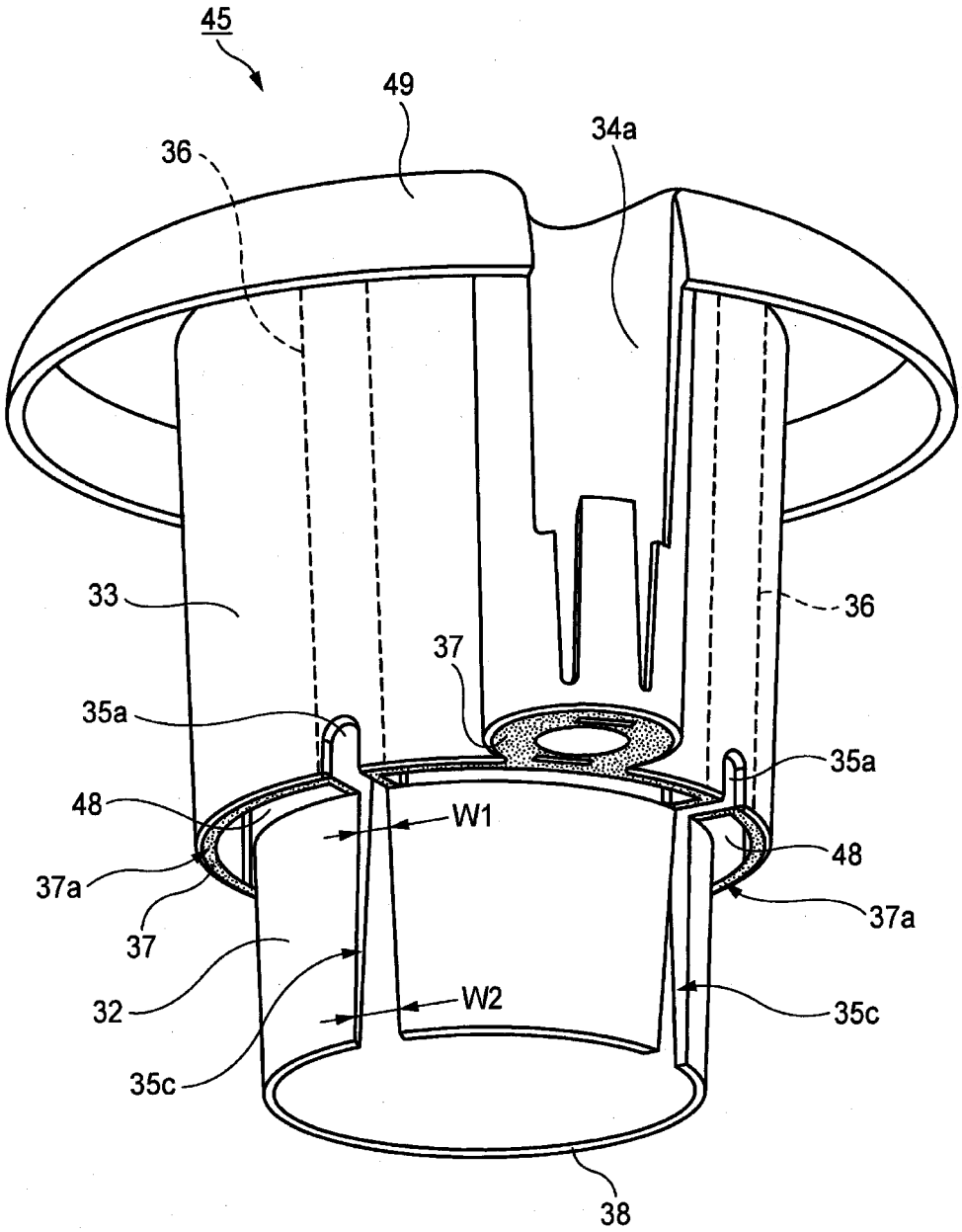
FIG. 7 is an enlarged perspective view, as viewed from below, of a funnel in an intake system according to a third embodiment of the present invention.
Figure 8:
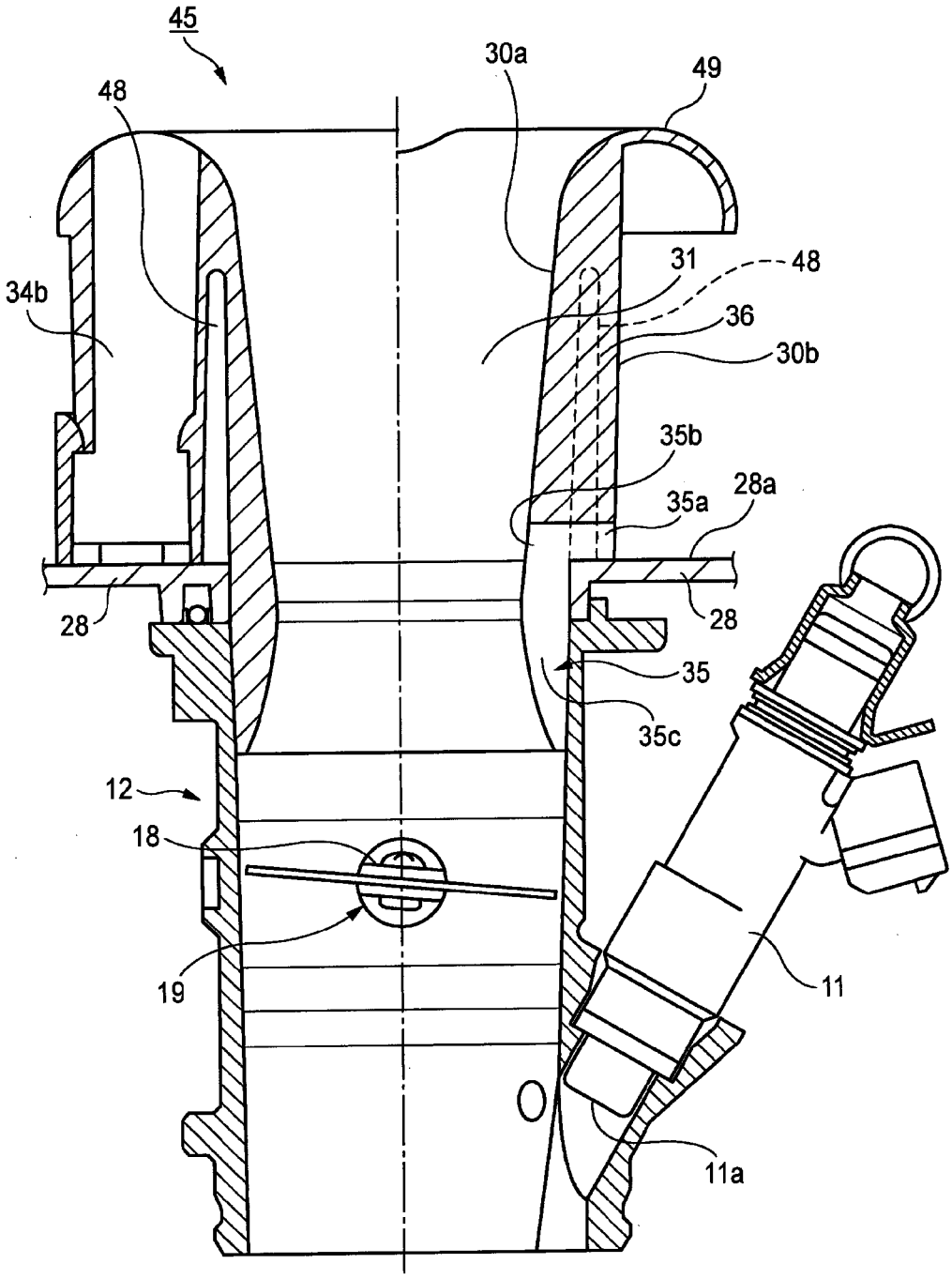
FIG. 8 is an enlarged sectional view showing a major part section of the funnel, in a mounted state, in the third embodiment shown in FIG. 7.

The third embodiment is the same as the second embodiment described above, except for the configuration of cutouts 35*c* in a funnel 45 shown in FIGS. 7 and 8. The same components as those in the second embodiment will be denoted by the same reference symbols as used above, and descriptions of them will be omitted as appropriate.

In the present embodiment, like in the second embodiment, the funnel 45 is provided to project into the clean air chamber 23 of the air cleaner case 20. Here, the funnel 45 in this embodiment is the same as the funnel 40 in the second embodiment above, in the shape of the upper end portion 49. In addition, as shown in FIGS. 7 and 8, the fitting portion 32 of the funnel 45 is formed with two cutouts 35*c*.

The cutouts 35*c* are provided at the same positions as the positions of the recessed grooves 35*g* in the second embodiment, and are formed as cutouts which are substantially the same as the recessed grooves 35*g* in shape. More specifically, the cutout 35*c* is cut from the downstream end surface 38 side toward the funnel upper end side up slightly into the range of the rib 36. In the funnel 45 in this embodiment, therefore, the passage inlet 35*a* and the passage outlet 35*b* are connected directly with each other in the radial direction of the fitting portion 32.

In addition, in the present embodiment, the cutout 35*c* is so shaped that its width is greater on the downstream end surface 38 side (W2>W1), but the shape of the cutout 35*c* is not particularly limited to this shape.

In this embodiment, since the bypass passages are composed of the cutouts in the fitting portion as described above, the bypass passages can be formed extremely easily and, further, the fitting portion can be deformed so as to be contracted in the radial direction.

Accordingly, the fitting portion 32 can be inserted into the throttle body even if some dimensional errors are present in the fitting portion 32. Consequently, very high assemblability can be secured.

While embodiments where the present invention is applied have been described above, the present invention is not limited to these embodiments. For instance, while a structure in which the bypass passages are formed by utilizing the recessed grooves formed in the funnel has been adopted in the above-described embodiments, a structure in which the funnel is not provided with any bypass passages can also be adopted in the present invention. More specifically, it suffices that a bypass passage has an inlet which opens at the inner wall surface of the clean air chamber in the air cleaner case and an outlet which opens into the throttle body. For example, there can be appropriately adopted a structure in which according to the structure of the inner wall surface of the clean air chamber in the air cleaner case, the inlet of the bypass passage is provided at a position where the surplus liquid is likely to be accumulated.

In addition, while a configuration in which two injectors are provided has been described in the embodiments above, a configuration in which the injector is provided only in the throttle body may naturally be adopted in the present invention. Furthermore, while an example in which the present invention is applied to a motorcycle has been shown in the above embodiments, the present invention is not limited to such an application but may be applied to other vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An intake system adapted for use with an internal combustion engine, comprising:

a funnel including a barrel portion defining an airflow passage, a stepped portion provided on the downstream side of said barrel portion to form a sealing surface between said funnel and an air cleaner case, and a fitting portion which is provided on the downstream side of said stepped portion and inserted inside of a throttle body;

a separate bypass passage distinct from said airflow passage, said separate bypass passage being formed in an outer periphery of said fitting portion between said clean air chamber in said air cleaner case and said throttle body; and a passage inlet formed in the bypass passage on said clean air chamber side opening at an inner wall surface of said air cleaner case and a passage outlet upstream of said throttle valve;

wherein said bypass passage is configured to extend along an axis of said throttle body and to gradually increase in bore sectional area from said passage inlet toward said passage outlet.

2. The intake system adapted for use with the internal combustion engine according to claim 1, wherein said bypass passage is a recessed groove provided in said fitting portion.

3. The intake system adapted for use with the internal combustion engine according to claim 1, wherein said bypass passage is a cutout provided in said fitting portion.

4. An intake system for an internal combustion engine wherein an airflow passage for sucking air from a clean air chamber of an air cleaner case into a throttle body equipped with a throttle valve through a funnel is formed and a fuel-air mixture is fed into an intake port, comprising:

said funnel includes a barrel portion defining said airflow passage, a stepped portion provided on the downstream side of said barrel portion to form a sealing surface between said funnel and said air cleaner case, and a fitting portion provided on the downstream side of said stepped portion and inserted inside of said throttle body;

a bypass passage different from said airflow passage is provided at an outer periphery of said fitting portion between said clean air chamber in said air cleaner case and said throttle body; and said bypass passage includes a passage inlet thereof on said clean air chamber side opening at an inner wall surface of said air cleaner case;

wherein said bypass passage is configured to extend along an axis of said throttle body and to gradually increase in bore sectional area from said passage inlet toward said passage outlet.

5. The intake system for the internal combustion engine according to claim 4, wherein said bypass passage is a cutout provided in said fitting portion.

6. The intake system for the internal combustion engine according to claim 4, wherein said bypass passage has a passage outlet thereof formed at a downstream end surface of said funnel.

7. The intake system for the internal combustion engine according to claim 5, wherein said bypass passage has a passage outlet thereof formed at a downstream end surface of said funnel.

8. The intake system for the internal combustion engine according to claim 4, wherein said bypass passage is configured to extend along an axis of said throttle body and to gradually increase in bore sectional area from said passage inlet toward said passage outlet.

9. The intake system for the internal combustion engine according to claim 5, wherein said bypass passage is configured to extend along an axis of said throttle body and to gradually increase in bore sectional area from said passage inlet toward said passage outlet.

10. The intake system for the internal combustion engine according to claim 4, wherein a plurality of said bypass passages are provided.

11. The intake system for the internal combustion engine according to claim 4, wherein a plurality of said bypass passages are provided.

12. The intake system for the internal combustion engine according to claim 5, wherein a plurality of said bypass passages are provided.

13. The intake system for the internal combustion engine according to claim 4, wherein said barrel portion has a space provided between an inner peripheral surface defining said airflow passage and an outer peripheral surface.

14. The intake system for the internal combustion engine according to claim 5, wherein said barrel portion has a space provided between an inner peripheral surface defining said airflow passage and an outer peripheral surface.

15. The intake system for the internal combustion engine according to claim 4, wherein said bypass passage is a recessed groove provided in said fitting portion.

16. The intake system for the internal combustion engine according to claim 11, wherein said bypass passage has a passage outlet thereof formed at a downstream end surface of said funnel.

17. The intake system for the internal combustion engine according to claim 11, wherein said bypass passage is configured to extend along an axis of said throttle body and to gradually increase in bore sectional area from said passage inlet toward said passage outlet.

18. The intake system for the internal combustion engine according to claim 15, wherein said barrel portion has a space provided between an inner peripheral surface defining said airflow passage and an outer peripheral surface.

* * * * *